US006670763B2

(12) United States Patent
Golz et al.

(10) Patent No.: US 6,670,763 B2
(45) Date of Patent: Dec. 30, 2003

(54) DISPLAY LAMP WITH REFLECTOR HAVING IR-REFLECTIVE COATING

(75) Inventors: Thomas M. Golz, Willoughby Hills, OH (US); Denis A. Lynch, South Euclid, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/858,062

(22) Filed: May 15, 2001

(65) Prior Publication Data

US 2002/0171364 A1 Nov. 21, 2002

(51) Int. Cl.[7] ..... H01J 13/46
(52) U.S. Cl. ..... 315/56; 313/324; 362/347
(58) Field of Search ..... 315/56, 57, 58, 315/326, 363; 313/312, 324, 325, 113; 362/341, 347, 296

(56) References Cited

U.S. PATENT DOCUMENTS

| | | | | |
|---|---|---|---|---|
| 4,707,632 A | | 11/1987 | Walsh | 313/112 |
| 4,780,799 A | | 10/1988 | Groh | 362/294 |
| 4,885,668 A | | 12/1989 | Maglica et al. | 362/315 |
| 5,177,396 A | * | 1/1993 | Gielen et al. | 313/113 |
| 5,680,000 A | | 10/1997 | Zuk et al. | 313/25 |
| 5,757,134 A | | 5/1998 | Williamson | 313/613 |
| 6,111,359 A | * | 8/2000 | Work et al. | 313/25 |
| 6,281,620 B1 | * | 8/2001 | Yeh | 313/113 |

* cited by examiner

*Primary Examiner*—Don Wong
*Assistant Examiner*—Thuy Vinh Tran
(74) *Attorney, Agent, or Firm*—Pearne & Gordon LLP

(57) ABSTRACT

A low voltage display lamp is provided for use in standard threaded lamp sockets. The lamp has an IR-reflective layer, preferably gold, coated on the convex side of the reflector to reflect infrared radiation (IR) away from the ballast to reduce the ballast's operating temperature. The IR-reflective coating is effective to reflect IR radiation away from the lamp housing.

20 Claims, 1 Drawing Sheet

DISPLAY LAMP WITH REFLECTOR HAVING IR-REFLECTIVE COATING

BACKGROUND OF THE INVENTION

This invention relates to display lamps. More particularly, it relates to low voltage display lamps having a gold-coated reflector to reduce heat radiation and transmittance.

Low voltage display lamps are known in the art. Low voltage display lamps for use in standard lamp sockets having line-voltage, such as, e.g., the well known MR16 lamps, comprise a reflector assembly that works in conjunction with a voltage converter such as a solid state electronic ballast. The ballast is contained within a lamp housing together with, disposed in close proximity to and directly behind the reflector assembly. Consequently, it is important to minimize radiant heat from the reflector assembly to the ballast in order to ensure proper operation and a long service life.

Current display lamp designs employ a flat circular heat shield or plate which is disposed behind the elliptical reflector of the reflector assembly and in front of the ballast. This heat shield serves to protect the ballast by reflecting infrared radiation (IR) generated by the filament and transmitted through the reflector, thereby reducing the ballast's operating temperature. However, a significant portion of the reflected IR is directed at the interior surface of the lamp housing. Consequently, the lamp housing, which is already subject to direct IR energy from the filament, now absorbs roughly twice the IR compared to that radiated directly from the filament to the housing.

The result is that the housing is more susceptible to melting from absorbed IR, and also that the absorbed IR will be conducted as heat through the housing material to the ballast, thereby raising the ballast operating temperature and shortening its service life.

Existing means for solving the problem of ballast heating include multi-layer coatings applied to the concave reflector surface that are designed to reflect IR instead of transmit it through the reflector toward the ballast.

However, such coatings are difficult to apply correctly and often are very expensive. Most such coatings involve applying a discrete IR-reflective coating layer separately from and beneath a visible light-reflective coating layer, thereby contributing an additional coating process. It has been further suggested that a broad-band dichroic coating that would reflect in both the visible and IR spectra could be used. However, such coatings would be difficult to apply correctly, and could adversely affect the lumen efficiency of the lamp.

There is a need in the art for a low voltage display lamp for use in standard line-voltage electric lamp sockets, comprising an effective IR-reflective coating that can be applied to the reflector, without adversely affecting the lumen efficiency or light-reflective characteristics of the lamp. Such a coating would effectively reflect IR away from the ballast, and from the lamp housing. Such a coating will effectively reduce the ballast operating temperature.

SUMMARY OF THE INVENTION

A low voltage display lamp is provided having a lamp housing, a reflector assembly, and a solid state electronic ballast. The reflector assembly has a light source therein, and is located within the lamp housing, with the ballast located behind the reflector assembly. The reflector assembly also has a reflector with a concave inner surface and a convex outer surface, and an IR-reflective layer is disposed on the convex outer surface.

DETAILED DESCRIPTION OF THE PREFERRED EMBODIMENTS OF THE INVENTION

In the description that follows, when a preferred range, such as 5 to 25 (or 5–25) is given, this means preferably at least 5, and separately and independently, preferably not more than 25.

As used herein, "MR16" means a low voltage display lamp as is generally known in the art, having a nominal diameter of two inches.

Figure 1:
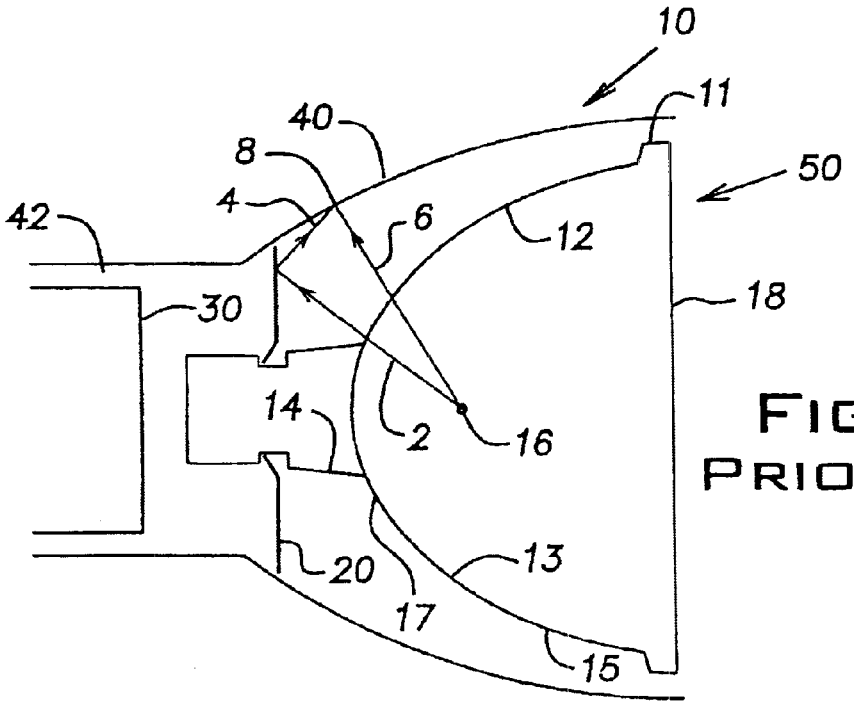
FIG. 1 PRIOR ART
FIG. 1 is a schematic side view of a low voltage display lamp having a flat circular heat shield characteristic of the prior art.

With reference to FIG. 1, pictured is a characteristic or conventional low voltage display lamp 10. The lamp 10 comprises a solid state ballast 30 and a reflector assembly 50, both contained within a lamp housing 40. Lamp 10 further comprises socket coupling means (preferably threaded) for electrically coupling the electronic ballast 30 to a lamp socket (not shown). The ballast 30 is disposed in the throat 42 of the housing 40 directly behind the reflector assembly 50. The reflector assembly 50 preferably comprises a curved reflector 12, preferably ranging from substantially elliptical to substantially parabolic in shape, a filament or light source 16, and a transparent cover plate 18. The reflector 12 has a concave inner surface 13 and a convex outer surface 15, and is preferably substantially parabolic in shape. A light-reflective coating layer (not shown) is coated onto concave surface 13. The reflector 12 typically comprises a borosilicate glass material. The light source 16 is disposed within the reflector 12, facing concave surface 13. During operation, light source 16 of reflector assembly 50 is electrically coupled to ballast 30 via metal pins, wires, or some other known means (not shown). The reflector 12 terminates in a rim 11 forming the entire perimeter of the open end of the reflector 12.

The lamp 10 may optionally comprise a nose or boss 14 formed integrally with and extending outwardly from the outer surface of the base 17 of the reflector 12. The boss 14 preferably has a rectangular cross-section, though cross-sections of other shapes are possible and can be used. Preferably, the reflector 12 and the boss 14 are integrally formed from glass, preferably borosilicate glass. The lamp of FIG. 2 is of this same general construction.

With reference to FIG. 1, a conventional lamp 10 comprises a conventional or known heat shield 20. The heat shield 20 is positioned between base 17 of reflector 12 and ballast 30 in order that the heat shield reflects IR transmitted through the reflector 12 away from the ballast 30. As can be seen in FIG. 1, a heat shield 20 as described above reflects incident radiation 2, and directs it as reflected radiation 4 toward a point 8 along the interior surface of the lamp housing 40. In addition to the reflected radiation 4, point 8 also receives direct radiation 6 from light source 16. Hence the reflected radiation 4 effectively doubles or increases the absorbed IR load at point 8, thereby significantly increasing the localized housing temperature around point 8. It will be understood that such double or enhanced absorption is not a discretized effect around a single point 8 as portrayed in FIG. 1. Discrete point 8 is pictured merely for illustration. This double absorption phenomenon occurs along the interior surface of housing 40, thereby significantly increasing its temperature.

Increased housing temperature increases the danger of housing meltdown, requiring that housing materials having high softening or melting points must be used. In addition, absorbed IR is conducted as heat through the housing back to the throat portion 42 which encloses the ballast 30. The conducted energy is then transferred to the ballast via conduction through the physical pathways between the ballast 30 and the housing 40, and via radiation from the housing 40 to the ballast 30. Additionally, thermal currents transfer thermal energy to the ballast via convection as known in the art. Thermal energy transferred to the ballast 30 via the above mechanisms raises the ballast's operating temperature thereby reducing its service life.

Figure 2:
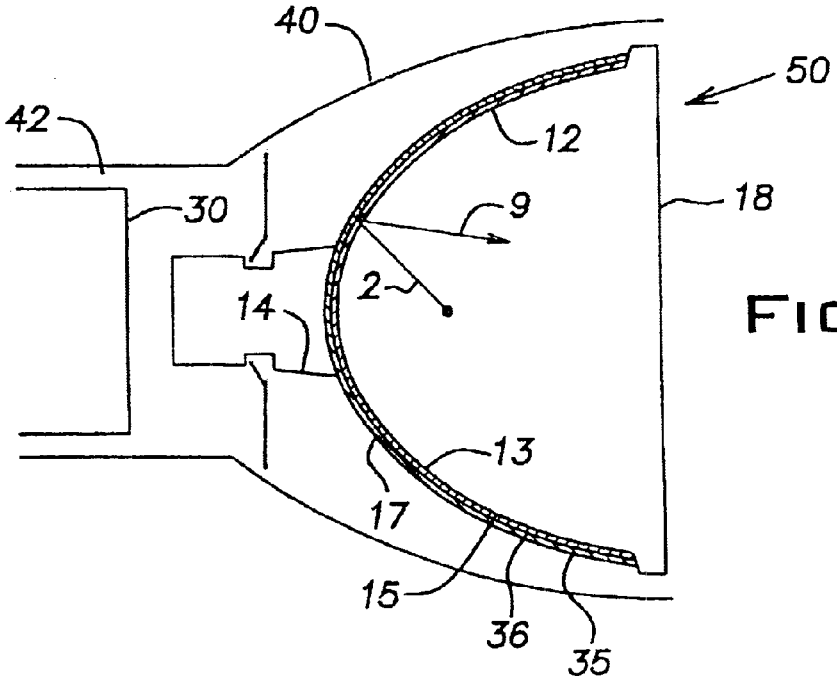
FIG. 2 is a partially schematic side view of a low voltage display lamp having an IR-reflective coating layer according to the present invention.

Now referring to FIG. 2, convex surface 15 of reflector 12 is coated with an IR-reflective layer 35 effective to reflect transmitted IR back through reflector 12 to exit lamp 10 through clear cover 18. IR-reflective layer 35 is made from a material capable of withstanding operating temperatures in excess of 200, preferably 250, preferably 300, preferably 350, preferably 400, ° C., without tarnishing, becoming oxidized, or otherwise being affected in a manner adverse to its IR-reflectivity. IR-reflective layer 35 is or comprises preferably a gold, less preferably silver, less preferably aluminum, less preferably nickel, less preferably titanium, less preferably chromium layer, less preferably some other metal layer, less preferably a metal alloy layer, less preferably some other material known in the art. Preferably, the reflective layer 35 is 50–200, preferably 60–180, preferably 75–160, preferably 90–140, preferably 100–130, preferably 110–125, preferably about 120, nm thick.

Gold is most preferred because it is highly impervious to adverse temperature effects, and does not tarnish, melt, oxidize, or otherwise deform under operating temperatures up to and in excess of 400° C. In addition, gold exhibits a substantially flat reflectivity profile throughout the relevant IR spectrum (about 0.7–4.0$\mu$ wavelength), at about 99% reflectivity. (The glass in reflector 12 is essentially fully absorbent of IR radiation beyond 4.0 $\mu$, transmitting none through to the reflective layer 35). When gold is used in reflective layer 35, a base layer 36 is preferably deposited on convex surface 15 between convex surface 15 and reflective layer 35, preferably by vacuum vapor deposition. Base layer 36 is as thin as possible to effectively serve its adhesive purpose. Base layer 36 is preferably less than 20, more preferably 16, more preferably 12, more preferably 10, more preferably 8, more preferably 6, more preferably 5, more preferably 4, nm thick. Base layer 36 is most preferably pure titanium or titanium, less preferably chromium, less preferably any other material (preferably metallic) having good adhesion to both surface 15 and the gold reflective layer.

It should be noted that gold can be deposited directly onto a glass surface. However gold exhibits very poor adhesion to glass, and thus immediately flakes off upon even the slightest contact. Nevertheless, because the gold layer in the finished lamp 10 is totally enclosed, it is possible to provide a gold reflective layer according to the present invention without a base layer 36, so long as the lamp is manufactured in such a way as to ensure no contact with the gold-deposited convex surface of reflector 12 once the gold has been deposited thereon. It is probable that such a manufacturing process would introduce excessive cost and would be quite cumbersome; accordingly it is preferable to provide the base layer 36 when a gold layer is used.

In a less preferred embodiment, use of some materials other than gold in reflective layer 35, for example silver or aluminum, will obviate the need for base layer 36 because such materials are sufficiently adherent to glass (borosilicate glass) to effectively adhere directly to convex surface 15 of reflector 12. Though silver has a substantially uniform reflectivity profile in the IR-spectrum, and similarly to gold is further about 99% reflective of IR radiation, silver suffers from the limitation that it tarnishes easily via oxidation at high temperature. Thus, when silver is used in reflective layer 35, the silver layer should be sufficiently thick such that tarnish cannot penetrate through the silver layer to the silver surface immediately adjacent convex surface 15. Alternatively, when silver is used in reflective layer 35, a protective coating layer, e.g. silica, can be deposited over the silver reflective layer to prevent silver tarnishing or oxidation. Providing such a thick silver layer will yield a silver reflective surface adjacent convex surface 15 that is substantially unaffected by tarnish from the opposite side of the silver layer. Thus reflective layer 35 may be disposed on convex outer surface 15 with or without the presence of base layer 36.

In addition to preventing direct IR radiation to ballast 30, and to preventing reflected IR from being directed toward housing 40 (see reference numeral 4 in FIG. 1), the reflective layer 35 also substantially prevents direct radiation to housing 40 from light source 16 (see reference numeral 6 in FIG. 1). As can be seen in FIG. 2, incident radiation 2 is directed forward through reflector 12 as reflected radiation 9, to exit the lamp. The transparent cover 18 transmits nearly 100% of the reflected IR, absorbing almost none. Consequently, the reflected IR substantially escapes the lamp, and therefore is not absorbed by the lamp housing 40 to raise its temperature. Optionally, a heat shield 20 can be disposed between reflector 12 and ballast 30 as shown in FIG. 1.

It is believed that invented reflective layer 35 will decrease the ballast temperature by 5–10° C. Current MR16 display lamps operate in the range of 20–71 watts (W). The higher the wattage, the greater the light output of the lamp. Ballasts used in conjunction, and in close proximity, with 20 W MR16 lamps operate near threshold temperature due to the transfer of heat from the light source 16 to the ballast 30 via the various mechanisms described above. The invented reflective layer 35 allows a ballast to be incorporated into a housing in close proximity with a higher wattage MR16 lamp, (e.g. at least or about 35 W, 45 W, 55 W, 65 W, or 71 W), and to operate sufficiently below threshold temperature to ensure long life, preferably rated at more than 3000, preferably 3500, preferably 4000, preferably 4500, preferably 5000, hours.

Though the above-described preferred embodiment has been described with regard to an MR16 lamp, it will be understood that the invention could be applied to display lamps of different shapes and sizes without departing from the scope of the invention. For example, the invented reflective layer 35 can be utilized in MR8, MR11, MR20, MR30, MR38, PAR16, PAR20, PAR30, and PAR38 display lamps, as well as any other reflector lamp known in the art, and would be similarly provided and comprised as described above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A low voltage display lamp comprising a lamp housing, a reflector assembly, and a solid state electronic ballast, said reflector assembly comprising a light source, said reflector assembly being disposed within said housing, said ballast being disposed behind said reflector assembly, said reflector assembly further comprising a reflector having a concave inner surface and a convex outer surface, and an IR-reflective layer disposed on said convex outer surface.

2. A lamp according to claim 1, said lamp further comprising a base layer disposed on said convex outer surface between said outer surface and said IR-reflective layer.

3. A lamp according to claim 2, wherein said base layer is titanium.

4. A lamp according to claim 2, wherein said base layer is chromium.

5. A lamp according to claim 2, wherein said base layer is less than 20 nm thick.

6. A lamp according to claim 2, wherein said IR-reflective layer is gold.

7. A lamp according to claim 1, wherein said IR-reflective layer is gold.

8. A lamp according to claim 1, wherein said IR-reflective layer is silver.

9. A lamp according to claim 8, further comprising a protective layer deposited over said silver IR-reflective layer.

10. A lamp according to claim 9, said protective layer being silica.

11. A lamp according to claim 1, wherein said IR-reflective layer is selected from the group consisting of titanium, chromium, nickel and aluminum.

12. A lamp according to claim 1, wherein said IR-reflective layer is 50–200 nm thick.

13. A lamp according to claim 1, further comprising a heat shield disposed between said reflector and said ballast.

14. A lamp according to claim 1, said lamp having a rated life longer than 3000 hours.

15. A lamp according to claim 1, further comprising a heat shield disposed between said reflector assembly and said ballast.

16. A lamp according to claim 1, wherein said reflector is substantially parabolic in shape.

17. A lamp according to claim 1, wherein said reflector is substantially elliptical in shape.

18. A lamp according to claim 1, said reflector comprising a glass material.

19. A lamp according to claim 1, said reflector comprising borosilicate glass.

20. A lamp according to claim 1, said reflector comprising a glass material, said IR-reflective layer that is disposed on said convex outer surface of said reflector being a metallic layer.

* * * * *